US005176990A

United States Patent [19]

Kim

[11] Patent Number: 5,176,990

[45] Date of Patent: Jan. 5, 1993

[54] METHOD OF FORMING A SILVER HALOIODIDE PHOTOGRAPHIC ELEMENT

[75] Inventor: Sang H. Kim, Pittsford, N.Y.

[73] Assignee: Eastman Kodak Company, Rochester, N.Y.

[21] Appl. No.: 631,679

[22] Filed: Dec. 21, 1990

[51] Int. Cl.[5] ..... G03C 1/74; G03C 1/035

[52] U.S. Cl. ..... 430/569; 430/617; 430/642; 430/935; 430/379; 430/502; 430/567

[58] Field of Search ..... 430/642, 935, 509, 346, 430/617, 569, 379, 502, 567

[56] References Cited

U.S. PATENT DOCUMENTS

| | | | |
|---|---|---|---|
| 3,396,027 | 8/1968 | McFall et al. | 430/642 |
| 4,639,417 | 1/1987 | Honda et al. | 430/567 |
| 4,640,890 | 2/1987 | Fujita et al. | 430/509 |
| 4,656,122 | 4/1987 | Sowinski | 430/505 |
| 4,786,587 | 11/1988 | Kuwabara | 430/566 |
| 4,801,522 | 1/1989 | Ellis | 430/569 |

FOREIGN PATENT DOCUMENTS

| | | | |
|---|---|---|---|
| 267483 | 5/1988 | European Pat. Off. | 430/935 |
| WO8906829 | 7/1989 | PCT Int'l Appl. | 430/935 |

*Primary Examiner*—Charles L. Bowers, Jr.
*Assistant Examiner*—Mark F. Huff
*Attorney, Agent, or Firm*—Foley & Lardner

[57] ABSTRACT

A method for forming a photographic element includes steps of heating an emulsion containing grains of a radiation sensitive silver haloiodide to form a first melt, heating an emulsion containing grains of a silver salt effective to enhance the photographic properties of the silver haloiodide emulsion to form a second melt, and coating the first and second melts onto a photographic support to form an image recording layer. The silver salt grains are substantially insensitive to radiation at wavelengths at which said silver haloiodide grains are sensitive. The coating step is preferably carried out by blending the first and second melts together, then immediately coating the silver haloiodide emulsion onto the support. In a preferred embodiment, the silver salt is essentially silver chloride in the form of relatively fine cubic grains, and the silver haloiodide is in the form of tabular grains larger than the cubic grains. The foregoing procedure unexpectedly improves the speed of the resulting photographic element. For color reversal photographic elements, the melt containing the fine silver salt grains is conveniently the coupler melt.

20 Claims, No Drawings

METHOD OF FORMING A SILVER HALOIODIDE PHOTOGRAPHIC ELEMENT

TECHNICAL FIELD

The present invention relates generally to a method for forming a photographic element using a silver halide emulsion, more particularly by using a silver halide emulsion containing a mixture of grain sizes which enhance performance of such elements.

BACKGROUND OF THE INVENTION

Reversal photographic elements produce a photographic image for viewing by a process of exposure of the element (film) to an image, development of the film to produce a negative of the image to be viewed, and then uniform exposure and/or fogging of residual silver halide and processing to produce a second, viewable image. In the preparation of a photographic elements for color reversal imaging, a coupler used to form a colored image is incorporated into a silver halide emulsion layer. Two methods have been used to coat film supports with emulsions in which a coupler is incorporated. In one, the coupler is added to the silver halide emulsion, and a single melt is made by heating the mixture to a temperature in the range of 35°–46° C. The resulting emulsion is filtered and then coated on the film support.

A second method provides better filtration control through a dual melt procedure in which the emulsion and coupler melts are made separately. Each is formed as a gelatin melt and heated to a temperature sufficiently high to render the melt flowable, typically about 40° C. The separate melts are mixed together and then the resulting mixture is immediately coated on the support. The coupler composition is usually hydrophobic, such that the admixture is an oil-in-water emulsion.

Mixtures of different kinds or sizes of silver halide grains have been used in various applications, such as X-ray films. See Honda et al. U.S. Pat. No. 4,639,417, issued Jan. 27, 1987, and Kuwabara, U.S. Pat. No. 4,786,587, issued Nov. 22, 1988. A combination of a separately prepared tabular grain emulsion and a Lippmann emulsion have been used for the purpose of transferring a dye from the silver salt grains to the tabular grains. See European Patent Publication No. 267,483.

High aspect ratio tabular grain silver haloiodide emulsions have been used in color reversal imaging to provide a variety of photographic advantages, such as improvements in speed-granularity relationships, increased image sharpness, and reduced blue speed of minus blue recording emulsion layers. Ellis, U.S. Pat. No. 4,801,522, issued Jan. 31, 1989 describes a process for preparing such tabular grains. It has been further recognized that the photographic properties of the tabular emulsion can be further improved by using an emulsion layer containing a blend of tabular silver haloiodide grains and relatively fine grains made of a silver salt more soluble than silver iodide. See Sowinski et al., U.S. Pat. No. 4,656,122, issued Apr. 7, 1987. Sowinski et al. give examples of using fine grains of silver bromide (AgBr), silver chlorobromide (AgClBr) or silver chloride (AgCl) with tabular grains of silver chlorobromoiodide (AgClBrI). However, this patent does not recognize that the manner in which the fine grains are added to the tabular grains in forming the photographic element can influence the performance of the resulting film.

SUMMARY OF THE INVENTION

A method for forming a photographic element according to the invention includes the steps of heating an emulsion containing grains of a radiation sensitive silver haloiodide to form a first melt, separately heating an emulsion containing grains of a silver salt effective to enhance the photographic properties of the silver haloiodide emulsion, and substantially insensitive to radiation at wavelengths at which the silver haloiodide grains are sensitive, to form a second melt, and coating the first and second melts onto a photographic support to form an image recording layer. The coating step is preferably carried out by blending the first and second melts together, then immediately coating the silver haloiodide emulsion onto the support. In a preferred embodiment, the silver salt is essentially silver chloride in the form of relatively fine cubic grains, and the silver haloiodide is in the form of tabular grains larger than the cubic grains. The foregoing procedure unexpectedly improves the speed of the resulting photographic element. For color reversal photographic elements, the melt containing the fine silver salt grains is conveniently the coupler melt.

DETAILED DESCRIPTION

In one aspect this invention is directed to a photographic element capable of forming a reversal image comprising a support and, coated on the support, at least one image recording emulsion layer comprised of a dispersing medium and a blend of radiation sensitive silver haloiodide grains and a second grain population present in a concentration sufficient to improve reversal photographic imaging, the second grain population having been added directly to the support without premixing with the emulsion containing the radiation sensitive silver haloiodide grains. The second grain population is generally incapable of forming a latent image, but extends the exposure latitude imparted to the radiation sensitive grains.

As the radiation sensitive grains, silver haloiodide tabular grains are preferred for the reasons noted above. Silver haloiodides comprise grains containing silver ions in combination with iodide ions and at least one of chloride and bromide ions. The tabular haloiodide grains employed in the practice of this invention contain in addition to iodide at least one of bromide and chloride. Such silver haloiodides include silver bromoiodides, silver chlorobromoiodides, and silver chloroiodides. Silver bromoiodide emulsions generally exhibit higher photographic speeds, and are thus preferred. Iodide must be present in the tabular silver haloiodide grains in a concentration sufficient to influence photographic performance, typically at least about 0.5 mole percent iodide. The silver haloiodide grains generally contain less than 15 mole percent iodide. Preferred iodide levels for tabular silver haloiodide grains are from 1 to 8 mole percent, optimally 2 to 7 mole percent. All of these iodide mole percentages are based on total silver present in the tabular grains.

Tabular grains are herein defined as grains having two substantially parallel crystal faces that are larger than any other crystal face on the grain. Tabular grain emulsions preferably have at least 50% of the grain population accounted for by tabular grains that satisfy the formula $AR/t>25$. In this formula, AR stands for aspect ratio, which equals D/t. D is the diameter of the grain in micrometers and t is the thickness of the grain between the two substantially parallel crystal faces in micrometers. The grain diameter D is determined by taking the surface area of one of the substantially parallel crystal faces, and calculating the diameter of a circle having an area equivalent to that of the crystal face. The grain size of the silver halide may have any distribution known to be useful in photographic compositions, and may be either polydisperse or monodisperse.

The fine silver salt grains preferably have an average diameter less than 0.7 μm, and are generally smaller than the photosensitive grains. However, under some circumstances the photosensitive grains may be the same size or slightly smaller than the silver salt grains. Thus, although the silver salt grains are referred to hereafter as the fine grains, the invention is not so limited.

The fine grains are preferably cubic grains, which are well known and easy to form, but other grain types such as octahedral, tetrahedral and tabular grains could be employed. The fine grains consist essentially of a silver salt more soluble in the emulsion medium than silver iodide. The relatively fine grain emulsion can, for example, be a relatively fine grain silver chloride, silver bromide, or silver thiocyanate emulsion, the preparations of which are well known to those skilled in the art and form no part of this invention. Emulsions combining the foregoing, such as silver chlorobromides, can also be used. However, the advantages of the invention are maximized using silver chloride, as shown in the example below.

The grains consisting essentially of the silver salt are fine and more soluble in the emulsion medium as compared to the photosensitive silver haloiodide grains. In general, the permissible size of this fine grain population blended with the radiation sensitive grains is a direct function of the solubility of the silver salt forming these grains. More soluble fine grains such as cubic AgCl may be larger than less soluble fine grains such as AgBr to achieve similar speed enhancement. The fine grain population preferably exhibits an average grain diameter of less than 0.7 μm, optimally 0.14 to 0.64 μm for silver chloride cubes. Any concentration of the second (fine) grain population can be employed that is capable of enhancing the photographic properties (e.g., speed and contrast) of the reversal photographic elements. Minimum fine grain population concentrations can range from as low as about 0.3 mole percent, based on total silver in the coated (blended) grain emulsion layer, with concentrations above about 1 mole percent being preferred and concentrations above about 8 mole percent being most preferred for maximizing photographic benefits.

The fine grain population is incapable of forming a latent image, and acts to extend the exposure latitude imparted to the emulsion layer by the larger silver haloiodide grains. When the large grains have received sufficient light exposure to reach their maximum level of developability, the fine grain population has not yet reached a threshold exposure for producing a latent image. The fine grain population need not be capable of forming a latent image at any level of exposure, since the latent image forming capability of the second grain population is not utilized in enhancing reversal imaging characteristics. A fine grain population having a latent image forming capability is not excluded from the practice of the invention, but its threshold exposure level is normally beyond the intended exposure latitude of the photographic element. Thus, the fine grain population preferably requires at least 0.3 log E greater exposure than that required to bring the large grains to a maximum level of developability. The relative insensitivity of the fine grains to exposing radiation as compared to the large grains can result from the difference in mean diameters. The difference in radiation sensitivity of the two grain populations can be increased by chemically sensitizing and/or spectrally sensitizing only the large grains. Conventional techniques for desensitizing the fine grain population can, if desired, be employed.

Reversal photographic elements of the invention can take the form of either black-and-white or color reversal photographic elements. Such photographic elements include a conventional photographic support, such as a transparent film support, onto which a grain emulsion layer is formed as described above. Although conventional overcoat and subbing layers are preferred, only the blended grain emulsion layer is essential. Following imagewise exposure, silver halide is imagewise developed to produce a first silver image, which need not be viewable. The first silver image can be removed by bleaching before further development when a silver or silver enhanced dye reversal image is desired. Thereafter, the residual silver halide is uniformly rendered developable by exposure or by fogging. Development produces a reversal image. The reversal image can be either a silver image, a silver enhanced dye image, or a dye image only, depending upon the specific choice of conventional processing techniques employed. If a dye only image is being produced, silver bleaching is usually deferred until after the final dye image is formed.

Photographic elements of this invention are preferably color reversal photographic elements capable of producing colored, particularly multicolored, images. Illustrative of such color reversal photographic elements are those disclosed by Kofron et al., U.S. Pat. No. 4,439,520 and Groet, U.S. Pat. No. 4,082,553, each cited above and here incorporated by reference. In a simple form such a color reversal photographic element can comprise a support having coated thereon at least three color forming layer units, including a blue recording yellow dye image forming layer unit, a green recording magenta dye image forming layer unit, and a red recording cyan dye image forming layer unit. Each color forming layer unit is comprised of at least one radiation sensitive silver halide emulsion layer. At least one radiation sensitive emulsion layer in each color forming layer unit is comprised of a blended grain emulsion as described above. The blended grain emulsions in each color forming layer unit can be chemically and spectrally sensitized as taught by Kofron et al., U.S. Pat. No. 4,439,520. In a preferred form chemical and spectral sensitization of the tabular grain emulsion is completed before blending with the fine grain population, which therefore remains substantially free of sensitizing materials.

One or more dye image providing materials, such as couplers, are preferably incorporated in each color forming layer unit, but can alternatively be introduced into the photographic element during processing. The melt containing the coupler comprises a conventional coupler mixture in a gel medium and further can contain the fine grains according to the invention. It has been found that the fine silver salt grains are less soluble in the coupler melt due to the absence of the silver haloiodide. For example, AgCl is more soluble than AgBrI under the conditions present in the emulsion containing AgBrI as the silver haloiodide. If the photosensitive AgBrI grains are present together with the AgCl grains during melting, bromine and iodine present in the photosensitive grains can attack the non-photosensitive AgCl grains. If the melts are prepared separately, more intact AgCl grains reach the photographic element as compared to a procedure wherein the fine grain population is preblended with the silver haloiodide emulsion prior to coating.

In a preferred dual melting procedure according to the invention, the silver haloiodide emulsion and the melt containing the silver salt grains, and the coupler, if needed, are made separately. The specific melt medium employed is not critical and may, for example, be gelatin. To hinder migration of the dye to the silver salt grains, the latter may also be treated with the dye, even though the silver salt grains are non-photosensitive compared to the silver haloiodide grains. If no dye is used on the silver haloiodide grains, none is used on the silver salt grains.

Each melt is then separately heated to a temperature sufficiently high to render the melt flowable, typically about 40° C. The separate melts are then mixed immediately prior to coating onto the support, which is carried out in a conventional manner using a knife or doctor blade. For this purpose, "immediately" means as soon as possible in practice, preferably less than about one minute. If this time is exceeded, the silver salt begins to degrade in the presence of the silver haloiodide. Under some conditions the melts can also be coated on the support successively, without preblending. Either procedure minimizes dissolution of the silver salt grains.

Other conventional layers may be formed, such as an undercoated antihalation layer (i.e., interposed between the silver haloiodide emulsion and the support) or an overcoated protective layer, for example, of gelatin, which is then hardened. In forming a high-speed color reversal film according to the invention using a silver bromoiodide T-grain emulsion containing at least 6 mole % iodine, the speed enhancement was maximized by using as the fine grains AgCl or AgClBr containing up to about 30 mole % Br.

The invention is illustrated by the following examples.

EXAMPLE 1

Four emulsions A, B, C and D were initially prepared. In the following description, the amounts used provided one mole of silver per emulsion.

The tabular grain emulsion, Emulsion A, was first prepared as follows. Silver nitrate (0.25 N) was added to a kettle containing 6.4 g/l NaBr, 0.2% bone gel, and 0.436 liter of distilled water at 70° C. at 6.387 cc/min for 1½ minutes. This was followed by addition of 0.2244 l of 1.57% bone gel. Emulsion grains were then grown by adding to the kettle, in an increasing flow, 2N silver nitrate, together with 2.75 N NaBr which controlled pAg at 8.6. Flow rates of silver nitrate were 3.138 cc/min for 10 minutes, increasing to 5.826 cc/min for 10 minutes, increasing to 9.4113 cc/min for 10 minutes, and finally to 13.891 cc/min for 10 minutes. These total 40 minute runs at 70° C. resulted in 54% of total silver being precipitated. Kettle pAg was then brought to about 9.5 by adding NaBr solution for 4 min at 13.44 cc/min and then 0.06 mole of a preformed silver iodide emulsion (about 0.05 μm) was added. The pAg was then brought to 8.6 by addition of 2 N silver nitrate, and grains were grown for 9 minutes. Remaining silver was run at 8.79 cc/min to reduce pAg to 8.0 and was run at 3.884 cc/min with NaBr solution for 5 min while maintaining pAg 8.0.

The resulting emulsion was cooled to 40° C. and ultrafiltered by the procedure of Mignot, U.S. Pat. No. 4,334,012, issued Jun. 8, 1982, the contents of which are incorporated herein by reference. 220 cc distilled water containing 5.5 g bone gel at 40° C. was added to the filtered emulsion. The emulsion pH and pAg were adjusted to 6.2 and 8.2 at 40° C., respectively. The resulting emulsion contained tabular grains with an aspect ratio (AR) of about 20 and AR/t=187. Median grain size was about 2.1 μm, and mean thickness was estimated to be 0.107 μm.

Emulsion A was then sensitized. To one mole of the Emulsion A there was added 0.1 mg $HgI_2$, 100mg NaCNS, 733 mg of dye A, below, 244 mg of dye B, below, 5.5 mg of sodium thiosulfate pentahydrate, 1.65 mg $KAuCl_4$, 22 mg of 3-methylbenzothiazolium iodide, and 2,750 mg KCl at 40° C. The temperature of the emulsion was elevated to 63° C. and held at that temperature for 15 minutes, whereafter it was cooled to chill set the emulsion. Heating and cooling was carried out at an absolute rate of 1.67° C./min. The dyes employed were:

Dye A

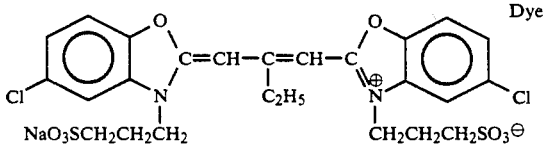

Dye B

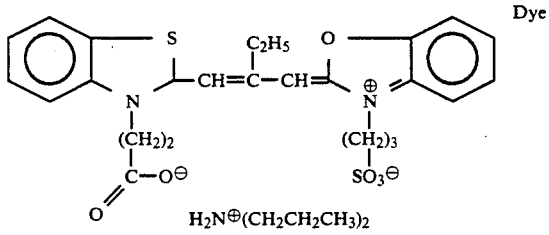

Cubic Emulsion B was prepared as follows. A kettle was initially filled with 2% bone gel (by volume) in 1.09 liter distilled water at 60° C. The pAg was adjusted to 6.33 by addition of 3N NaCl, and pH was similarly adjusted to 5.54 by addition of 2N sulfuric acid. Silver nitrate (3N) was then added to the kettle while maintaining pAg at 6.33 using 3N NaCl. Flow rates were 3.46 cc/min for 3 minutes of constant flow, 3.46 to 29.87 cc/min for 14 minutes linearly accelerated flow, and 29.87 cc/min for three minutes constant flow, for a total of 20 minutes precipitation. Kettle temperature was then reduced to 40° C., and pAg and pH were adjusted to 7.9I and 2.0, respectively. The resulting emulsion was washed in the same manner as Emulsion A, and the final Emulsion B was made up by adding 20.51 g/mole bone gel and adjusting pAg and pH to 6.93 and 5.6, respectively.

Emulsion C. was formed in the same manner as Emulsion B, except that a mixture of 2.1 N NaCl and 0.9 N NaBr replaced the 3N NaCl used in emulsion grain growth. Similarly, Emulsion D was prepared in the same manner as Emulsion B, except that a mixture of 0.9N NaCl and 2.1 N NaBr replaced the 3N NaCl. Emulsions B, C. and D yielded 0.35, 0.33 and 0.27 micron grains respectively. In emulsions C. and D, the chlorine-bromine content was 70:30 and 30:70, respectively.

Film coatings were prepared as follows. An emulsion layer (E-melt) containing a total of 75 mg/ft$^2$ of silver and 220 mg/ft$^2$ of gel was made by mixing the emulsion melt (E) and a dispersion melt (C-melt) together right before coating at 40° C. in a dual melting procedure. Both were coated on a cellulose acetate support at 3.7 cc/ft$^2$ each at a coating speed of 30 ft/min. The E-melt contained silver and gel (2.89%). The C-melt was prepared containing 1.1 wt. % bone gel, 27.7 wt. % of a magenta coupler dispersion, 0.043 wt. % of 5-bromo-4-hydroxy-6-methyl-1,3,3a,7-tetraazaindene (Bromo-TAI) and 2 wt. % of a surfactant mixture (Triton X-200 ®:Olin 10G ® in a ratio of 3:1). The magenta coupler dispersion comprised 9% of a coupler having the formula:

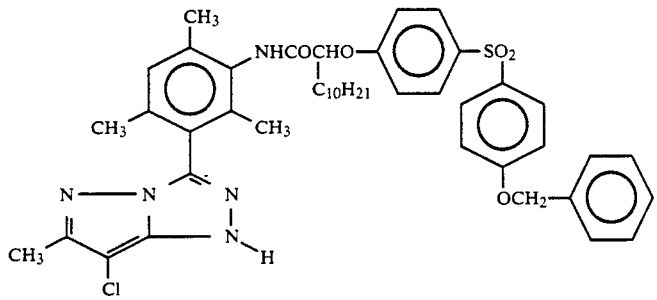

4.5 % of tris(methylphenyl) phosphoric acid ester, 6 % bone gel, and 0.9% Alkanol-XC ®. Triton X-200 ® is p-tert octylphenoxy ethoxyethyl sodium sulfate. The magenta coupler coverage was 115 mg/ft$^2$. Bromo-TAI level was 2.27 g/mole silver. The C-melt contained 2.97 % gel.

The cubic Emulsions B-D were each added to either the C-melt or the E-melt in amounts sufficient to give 8 mole % total silver. The pH of the respective E-melts was 5.9, and pAg was adjusted to 8.2 by a NaBr solution. The pH of the C-melts was 5.1, and pAg of each C-melt was adjusted to either 7.17 or 6.8 by addition of a dilute $AgNO_3$ solution.

Each emulsion layer was coated on a gel-coated antihalation cellulose acetate support and a 220 mg/ft$^2$ gelatin protective layer was coated over the emulsion layer and then hardened by 1,1'-[methylenebis(sulfonyl)]-bisethane (1.55 wt. % of total gel).

The resulting emulsion coatings were exposed through a Wratten 9 filter at 1/50 sec 5500K. These were processed to form positive images for 4 minutes in a color developer described in *British Journal of Photography Annual*, 1982, pages 201-203. Speed was determined at $D_{max}$ 0.3 density. Fog was measured by developing the emulsion coatings to form a negative black and white image for 4 minutes, followed by forming a negative color image. $D_{max}$ and speed loss were calculated after 2 weeks storage at 120° F. in an unexposed state compared to 0° F. stored film. The results are summarized in Table 1 below:

TABLE 1

| Cubic Emulsions | Added Into | Fresh Fog | Fresh Speed* | % $D_{max}$ Loss | Speed Loss |
|---|---|---|---|---|---|
| Emulsion B (AgCl) | | | | | |

TABLE 1-continued

| Cubic Emulsions | Added Into | Fresh Fog | Fresh Speed* | % $D_{max}$ Loss | Speed Loss |
|---|---|---|---|---|---|
| comparison | E-melt | 0.05 | 225 | 32% | −31 |
| invention | C-melt | 0.06 | 242 | 39% | −33 |
| Emulsion C (AgClBr 70:30) | | | | | |
| comparison | E-melt | 0.10 | 225 | 26% | −28 |
| invention | C-melt | 0.07 | 234 | 21% | −26 |
| Emulsion D (AgClBr 30:70) | | | | | |
| comparison | E-melt | 0.09 | 224 | 13% | −7 |
| invention | C-melt | 0.10 | 230 | 15% | −19 |
| Emulsion A only | None | 0.08 | 223 | 5% | −11 |

*Relative speed in log E multiplied by 100.

The results show that, when the cubic Emulsions B-D are added into the E-melt, no significant speed gain was observed. On the other hand, when each cubic emulsion was added to the C-melt, there was an unexpected increase in speed. The magnitude of the speed depends on the chloride content of the cubic emulsion, as illustrated by the results for Emulsions C. and D. It appeared that the solubility of the AgCl and AgClBr emulsions was greater in the E-melt than in the C-melt. The method of the invention prevented the dissolution of the AgCl or AgClBr, giving rise to better speed enhancement.

Variations on the foregoing procedure showed that changing the size of the tabular grains yields no apparent trend in speed improvement. Similarly, no trend was noted when the cubic grain size was varied in the range of 0.14–0.64 μm, or when different couplers were used. Thus, the speed improvement appears to be a general result of forming the silver salt melt separately from the silver haloiodide melt.

The foregoing results showed that photographic elements according to the invention deteriorated more rapidly than the comparative elements after a period of storage. A color multilayered film created using substantially the same procedure as set forth in this example showed the same speed improvement. In a color negative system, lower speed increases are observed. Examination of the E-melts and coatings of this example in an electron microscope showed that the cubic grains tended to survive and deposit on the faces of the T-grains better when preblended with the C-melt than when preblended with the E-melt.

EXAMPLE 2

Sowinski et al., U.S. Pat. No. 4,656,122, provides no teaching as to how to add fine grains to emulsions. This example examines the method of the present invention using a Lippmann AgBr emulsion added to a tabular grain emulsion E which was prepared by the following procedure. The amount used provided one mole of emulsion.

Silver nitrate (2.75 N) was added to a kettle containing 4.632 g/l NaBr, 0.13% bone gel, and 0.573 liter distilled water at 60° C. at 3.215 cc/min for four minutes. For the last two minutes, salt solution A (2.55 N NaBr+0.2 N KI) was added simultaneously to control pAg 8.75. Then 0.3015 liter of 0 63 % bone gel was added to the kettle and the emulsion was held for 10 minutes. The addition of the silver nitrate solution was continued for 10 minutes while controlling pAg at 8.6 by the salt solution A, followed by an increasing flow rate of the silver nitrate solution from 3.306 to 6.139 cc/min for 10 minutes, from 6.139 to 9.918 cc/min for 10 minutes, and from 9.918 to 13.74 cc/min for 9 minutes. The pAg was then brought to about 8.3 by addition of the silver nitrate solution at 3.306 cc/min for 0.95 minute.

The emulsion was grown further by adding the silver nitrate solution at 6.893 cc/min for 8 minutes and then 3.447 cc/min for 7.3 minutes while controlling pAg at 8.3 by addition of 2.75 N NaBr solution. The emulsion was then cooled to 40° C. and was ultrafiltered as described in the Example 1. 100 cc of distilled water containing 20g bone gel at 40° C. was added to the filtered emulsion. The emulsion pH and pAg were adjusted to 5.6 and 8.2 at 40° C., respectively. The resultant silver bromoiodide emulsion containing 6.2% I comprised tabular grains with median size of 0.45 micrometer, mean thickness of 0.093 micrometer and value of AR/t equal to 52.

This emulsion E was then sensitized as described in the Example 1, except that 0.1 mg $HgCl_2$, 250 mg NaCNS, 1,445 mg dye A, 481 mg dye B, 6.91 mg $Na_3Au(S_2O_3)_2.2H_2O$, 6.67 mg sodium thiosulfate pentahydrate, and 30 mg 3(N-methylsulfonyl) carbamoylethyl benzothiazolium tetrafluoroborate was added to one mole of emulsion, followed by 25 minutes digestion at 70° C.

Film coatings were prepared and evaluated as described in the Example 1 except that 0.08 micrometer AgBr Lippmann emulsion was used in place of cubic emulsions B, C, D. 5 or 10 mg per sq.ft. were coated with the tabular grains at 75 mg/sq.ft. total silver coverage. The results are shown in Table 2 below:

TABLE 2

| AgBr Lippmann Emulsions | Added Into | Fresh Fog | Fresh Speed | % $D_{max}$ Loss | Speed Loss |
|---|---|---|---|---|---|
| 5 mg/sq. ft. AgBr Lippmann | | | | | |
| comparison | E-melt | 0.08 | 195 | 28% | −4 |
| invention | C-melt | 0.05 | 189 | 14% | 2 |
| 10 mg/sq. ft. AgBr Lippmann | | | | | |
| comparison | E-melt | 0.06 | 189 | 32% | −3 |
| invention | C-melt | 0.05 | 190 | 4% | 14 |
| Emulsion E only | | 0.08 | 182 | 15% | 6 |

The fresh and keeping results suggested that it didn't matter how the Lippmann AgBr emulsion was added in terms of the fresh speed as taught by the Sowinski patent, but adding it to the C-melt provided better keeping. Again, the difference we see here from the AgBr emulsion compared to more soluble AgCl or AgClBr arise from differences in solubilities.

While several embodiments of the invention have been described, it will be understood that it is capable of further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A method for forming a photographic element, comprising the steps of:

heating an emulsion containing grains of a radiation sensitive silver haloiodide to form a first melt;

separately heating an emulsion containing grains of a silver salt effective to enhance the photographic properties of the silver haloiodide emulsion, and substantially insensitive to radiation at wavelengths at which said silver haloiodide grains are sensitive, to form a second melt; and coating the first and second melts onto a photographic support to form an image recording layer wherein the silver haloiodide grains and the silver salt grains are blended together.

2. The method of claim 1, wherein said coating step further comprises blending the first and second melts together, then immediately coating the resulting blend onto a photographic support to form an image recording layer.

3. The method of claim 1 wherein the element is a color reversal photographic element, and the second melt contains a coupler.

4. The method of claim 1, wherein the silver salt grains are cubic grains, and the silver haloiodide grains are tabular grains.

5. The method of claim 4, wherein the silver haloiodide tabular grains are larger than the silver salt cubic grains.

6. The method of claim 5, wherein the silver salt grains comprise cubic grains having an average diameter of less than about 0.7 μm and containing at least about 1 mole percent of the total silver in the first and second melts.

7. The method of claim 6, wherein the silver salt grains consist essentially of silver chloride cubes having an average diameter from about 0.14 to 0.64 μma nd containing at least about 8 mole percent of the total silver in the first and second melts.

8. The method of claim 7, wherein the silver haloiodide grains contain from about 1 to 8 mole % iodide.

9. The method of claim 1, wherein the silver salt is selected from silver chloride, silver bromide, silver chlorobromides, silver thiocyanate, and mixtures thereof.

10. The method of claim 1, wherein the silver salt is selected from silver chloride and silver chlorobromides containing up to about 30 mole % bromine, and the silver haloiodide consists essentially of silver bromoiodide containing at least about 0.5 mole % iodine.

11. A photographic element made by the method of claim 10.

12. A photographic element made by the method of claim 1.

13. The method of claim 1, wherein the silver haloiodide grains contain from 0.5 to 15 mole % iodide.

14. The method of claim 1, wherein the silver haloiodide grains are tabular grains having an aspect ratio greater than about 25 and contain from 1 to 8 mole % iodide.

15. The method of claim 1, wherein each of the melts is heated to at least about 40° C.

16. The method of claim 1, wherein said coating step further comprises coating the melts successively onto the support.

17. In a method for forming a color reversal photographic element, including the steps of forming at least three photosensitive, color-forming layer units on a support, the improvement wherein at least one of the color-forming layers includes an image recording layer made by:

heating an emulsion containing grains of a radiation sensitive silver haloiodide to form a first melt;

separately heating an emulsion containing a dye-image forming coupler and silver chloride grains effective to enhance the photographic properties of the silver haloiodide emulsion, and substantially insensitive to radiation at wavelengths at which said silver haloiodide grains are sensitive, to form a second melt; and coating the first and second melts onto a photographic support to form an image recording layer wherein the silver haloiodide grains and the silver chloride grains are blended together.

18. The method of claim 17, wherein the silver haloiodide grains consist essentially of silver bromoiodide tabular grains containing at least 6 mole % iodide, and the silver chloride grains are cubic grains consisting essentially of silver chloride having an average diameter of less than about 0.7 μm and containing at least about 1 mole percent of the total silver in the first and second melts, the tabular grains being larger than the cubic grains.

19. The method of claim 18, wherein said coating step further comprises blending the first and second melts together, then immediately coating the resulting blend onto a photographic support to form an image recording layer.

20. A color photographic element made by the method of claim 19.

* * * * *

UNITED STATES PATENT AND TRADEMARK OFFICE

CERTIFICATE OF CORRECTION

PATENT NO. : 5,176,990

DATED : January 5, 1993

INVENTOR(S) : Sang H. Kim

It is certified that error appears in the above-identified patent and that said Letters Patent is hereby corrected as shown below:

Column 10, line 47, after "0.64" please delete "μma nd" and insert - - μm and - - .

Signed and Sealed this

Fifteenth Day of February, 1994

*Attest:*

*Attesting Officer*

Bruce Lehman

BRUCE LEHMAN

*Commissioner of Patents and Trademarks*